US010910752B2

(12) United States Patent
Kimura et al.

(10) Patent No.: US 10,910,752 B2
(45) Date of Patent: Feb. 2, 2021

(54) LARGE CURRENT TERMINAL AND CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Akio Kimura, Mie (JP); Kyohei Ida, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/618,422

(22) PCT Filed: May 23, 2018

(86) PCT No.: PCT/JP2018/019755
§ 371 (c)(1),
(2) Date: Dec. 2, 2019

(87) PCT Pub. No.: WO2018/230282
PCT Pub. Date: Dec. 20, 2018

(65) Prior Publication Data

US 2020/0099158 A1 Mar. 26, 2020

(30) Foreign Application Priority Data

Jun. 13, 2017 (JP) ..... 2017-115711

(51) Int. Cl.
*H01R 12/00* (2006.01)
*H01R 13/187* (2006.01)
(Continued)

(52) U.S. Cl.
CPC ..... *H01R 13/187* (2013.01); *H01R 13/42* (2013.01); *H01R 13/53* (2013.01)

(58) Field of Classification Search
CPC .. H01R 23/722; H01R 23/725; H01R 33/971; H01R 23/6886; H01R 13/187
(Continued)

(56) References Cited

U.S. PATENT DOCUMENTS

2013/0130556 A1* 5/2013 Blakborn ..... H01R 13/187 439/626
2019/0245293 A1 8/2019 Kimura et al.

FOREIGN PATENT DOCUMENTS

DE 1 440 782 12/1968
JP 2000-268901 9/2000
(Continued)

OTHER PUBLICATIONS

International Search Report dated Aug. 14, 2018.

*Primary Examiner* — Phuong Chi Thi Nguyen
(74) *Attorney, Agent, or Firm* — Gerald E. Hespos; Michael J. Porco; Matthew T. Hespos

(57) ABSTRACT

A large-current terminal (30) includes a male terminal (50) having a male-side contact surface (54), a female terminal (60) having a female-side contact surface (64), a coil spring (70) including male-side contacts (72) for contacting the male-side contact surface (54) and female-side contacts (71) for contacting the female-side contact surface (64). A spring holder (40) holds the coils spring (70) and includes male-side and female-side openings (44, 45) for exposing the male-side and female-side contacts (72, 71). The coil spring (70) is compressed in a facing direction of the contact surfaces (54, 64) by disposing the male-side contact surface (54) to face both the female-side contact surface (64) and the male-side openings (44) with the female-side contact surface (64) directed toward the female-side openings (45). The spring holder (40) is movable such that the female-side
(Continued)

opening (45) approaches the female-side contact surface (64) as the coil spring (70) is compressed.

3 Claims, 9 Drawing Sheets

(51) Int. Cl.
*H01R 13/42* (2006.01)
*H01R 13/53* (2006.01)

(58) Field of Classification Search
USPC ..... 439/66, 74, 245, 591, 840
See application file for complete search history.

(56) References Cited

FOREIGN PATENT DOCUMENTS

| | | |
|---|---|---|
| JP | 2013-535777 | 9/2013 |
| JP | 2017-091835 | 5/2017 |
| JP | 2018-006246 | 1/2018 |
| WO | 2018-008384 | 1/2018 |

* cited by examiner

LARGE CURRENT TERMINAL AND CONNECTOR

BACKGROUND

Field of the Invention

This specification relates to a large current terminal and a connector.

Related Art

Japanese Unexamined Patent Application Publication No. 2013-535777 discloses a high current plug-in connector with a large current terminal. This connector includes a mating plug-in connector and a housing that is made of a conductive material and into which the mating plug-in connector is inserted. The mating plug-in connector is a busbar in the form of a flat plate. On the other hand, coil springs and a mounting member made of a conductive material are disposed inside the housing. The mounting member includes spigots inserted into axial centers of the coil springs to hold the coil springs, and the mounting member is inserted into the housing with the spigots inserted in the coil springs.

If the size of the mating plug-in connector is changed in the above high current plug-in connector, the shape of the housing into which the mating plug-in connector is inserted has to be changed. The shape of the mounting member to be disposed inside the housing also has to be changed. Thus, the size of the mating plug-in connector could not be changed easily. Therefore, it was not easy to use the above high current plug-in connector for higher current application.

SUMMARY

A large current terminal disclosed by this specification comprises a male terminal having a male-side contact surface, a female terminal having a female-side contact surface, a coil spring including male-side contact point portions to be brought into contact with the male-side contact surface and female-side contact points to be brought into contact with the female-side contact surface. The coil spring conductively connects the male terminal and the female terminal. A spring holder includes a male-side opening for exposing the male-side contact points and a female-side opening for exposing the female-side contact points. The spring holder holding the coil spring. More particularly, the coil spring is compressed in a facing direction of the contact surfaces by disposing the male-side contact surface in the male-side opening while causing the male-side contact surface to face the female-side contact surface with the female-side contact surface directed toward the female-side opening. The spring holder is movable such that the female-side opening approaches the female-side contact surface as the coil spring is compressed.

According to this configuration, the terminals are connected conductively by the coil spring being compressed and sandwiched in the facing direction of the contact surfaces by the male-side contact surface of the male terminal and the female-side contact surface of the female terminal. At this time, the spring holder moves such that the female-side opening approaches the female-side contact surface. By adopting this configuration, the spring holder moves as the coil spring is compressed, for example, even if the size of the male terminal is increased and the coil spring is compressed more. Thus, the shape of the spring holder need not be changed.

On the other hand, for example, if the size of the female terminal is increased, the shape of the spring holder need not be changed since the coil spring only has to be compressed between the female-side contact surface and the spring holder. Similarly, even if the size of the coil spring is increased, the shape of the spring holder need not be changed since the coil spring only has to be compressed between the female-side contact surface and the spring holder. Therefore, the sizes of the both male and female terminals and the coil spring can be changed easily changed in the large current terminal.

The coil spring may include arcuate couplings connecting the male-side contact points and the corresponding female-side contact points and the couplings may be inclined with respect to an axial center in a side view. The male terminal may be inserted in parallel to the axial center of the coil spring from one end toward the other end of the male-side opening, and an angle of inclination of the couplings with respect to the male-side contact surface serving as a reference surface may be an acute angle on one end of the male-side opening and an obtuse angle on the other end in the side view.

According to this configuration, since the angle of inclination of the couplings is the acute angle on the one end of the male-side opening, the coil spring is deformed to tilt the couplings when the male terminal is inserted from the one end toward the other end of the male-side opening. Thus, the male terminal can be inserted with a low insertion force. Contrary to this, if an attempt is made to separate the male terminal from the other end toward the one end of the male-side opening, the couplings hold on to stand up. Thus, the vertical drag of the male-side contact points against the male-side contact surface increases and a frictional force increases. Therefore, the male terminal is connected to the coil spring with a high holding force and hardly is separated from the coil spring.

This specification also relates to a connector with the above large current terminal, and a housing including a female terminal holding portion for holding the female terminal and a male terminal inserting portion. The male terminal is inserted into the male terminal inserting portion. The female terminal may a busbar in the form of a flat plate, and the spring holder may include two holding portions to be hooked to both side edge parts of the female terminal from a side opposite to the female-side contact surface and is held on the female terminal by the holding portions.

According to this configuration, if the female terminal is held in the female terminal holding portion and the spring holder is mounted on the female terminal, the spring holder is held on the female terminal by the two holding portions. If the male terminal subsequently is inserted into the male terminal inserting portion, the male and female terminals are connected conductively via the coil spring.

According to the large current terminal disclosed by this specification, the sizes of both male and female terminals and the coil spring can be changed easily.

DETAILED DESCRIPTION

Figure 1:
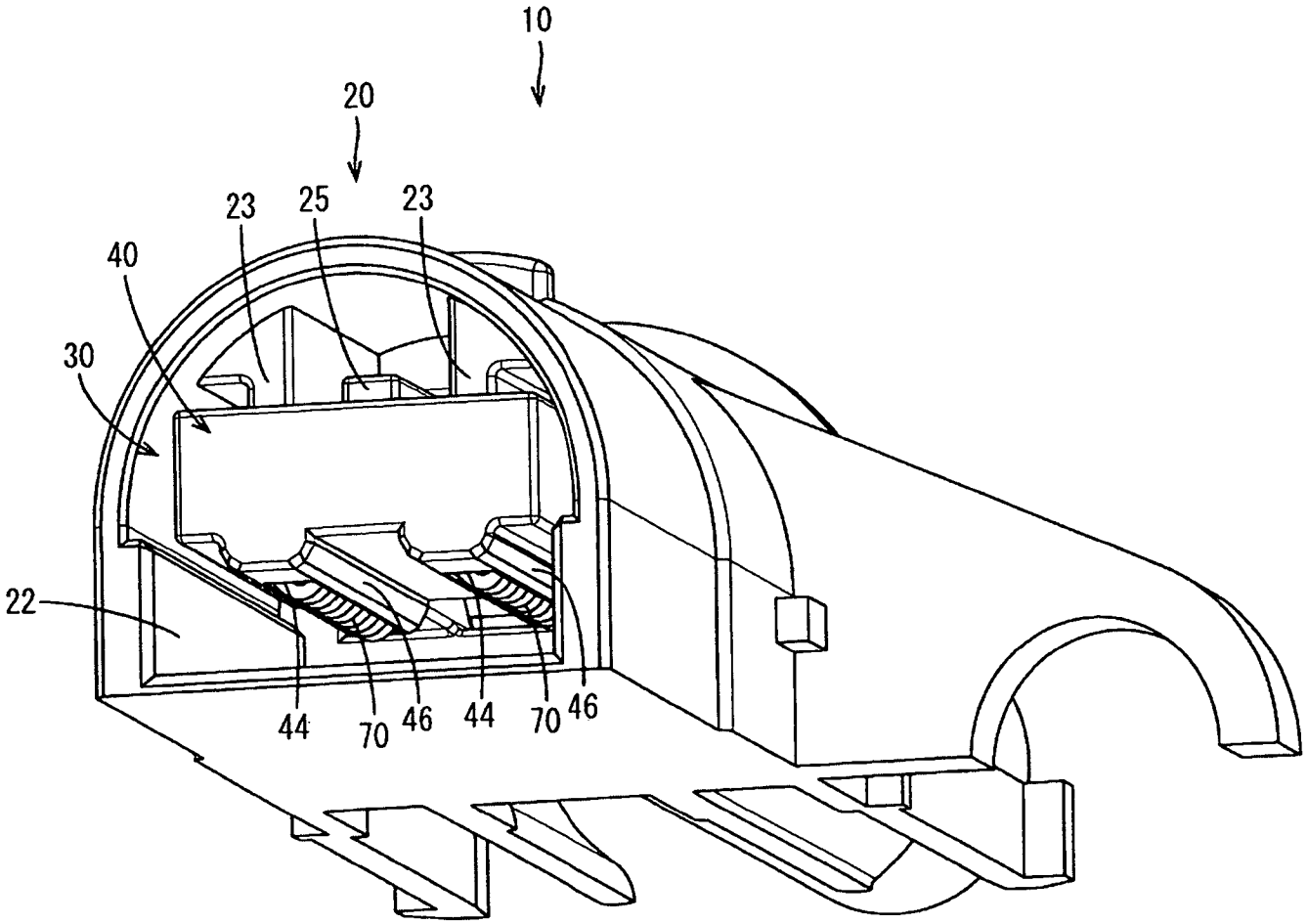
FIG. 1 is a perspective view of a connector before a male terminal is inserted.
Figure 2:
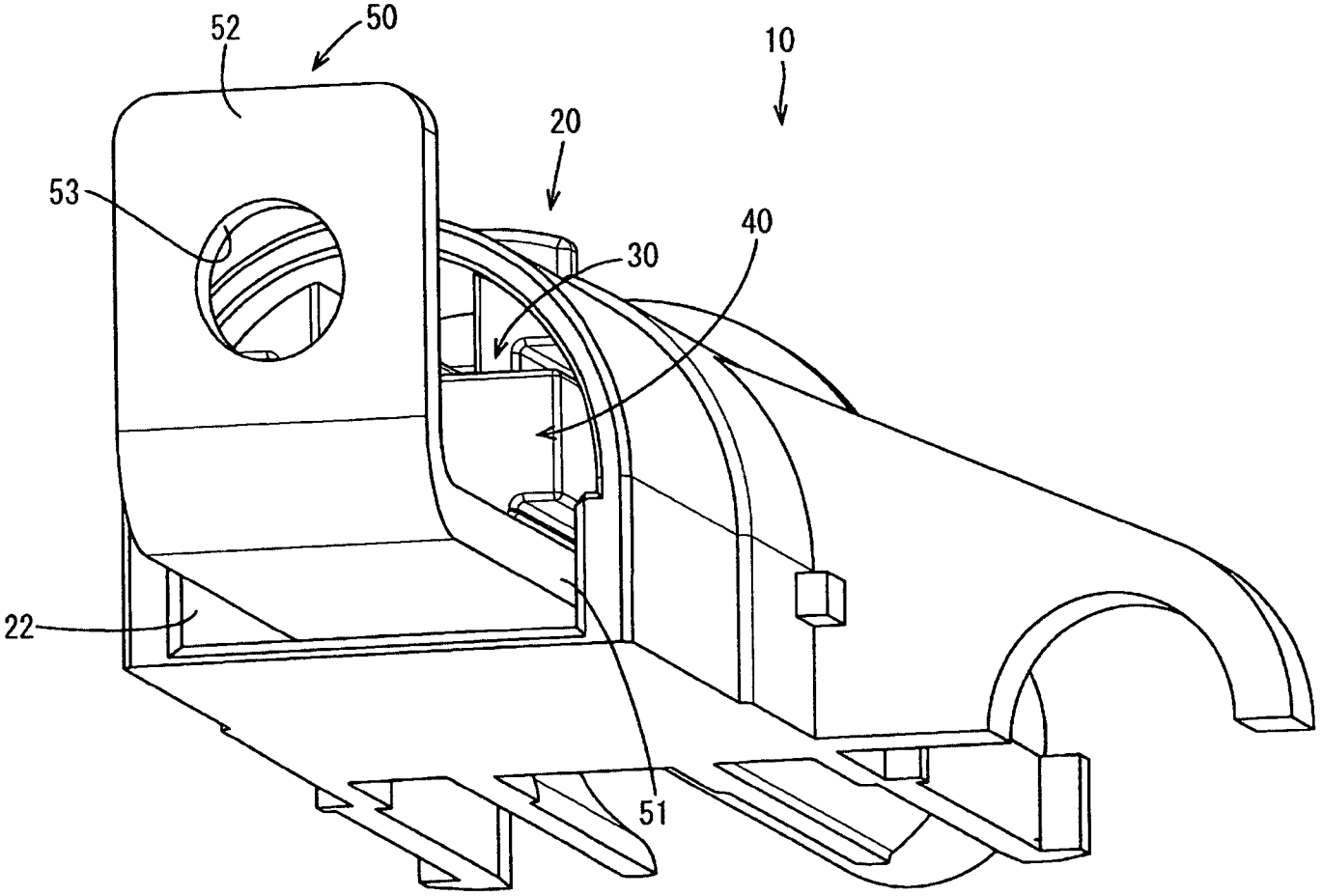
FIG. 2 is a perspective view of the connector after the male terminal is inserted.

An embodiment is described with reference to FIGS. 1 to 9. A connector 10 of this embodiment includes, as shown in FIG. 2, a housing 20 made of synthetic resin and a large current terminal 30 held in the housing 20. As shown in FIG. 6, the large current terminal 30 includes a spring holder 40 made of synthetic resin, coil springs 70 held in the spring holder 40, and a male terminal 50 and a female terminal 60 conductively connected via the coil springs 70.

Figure 3:
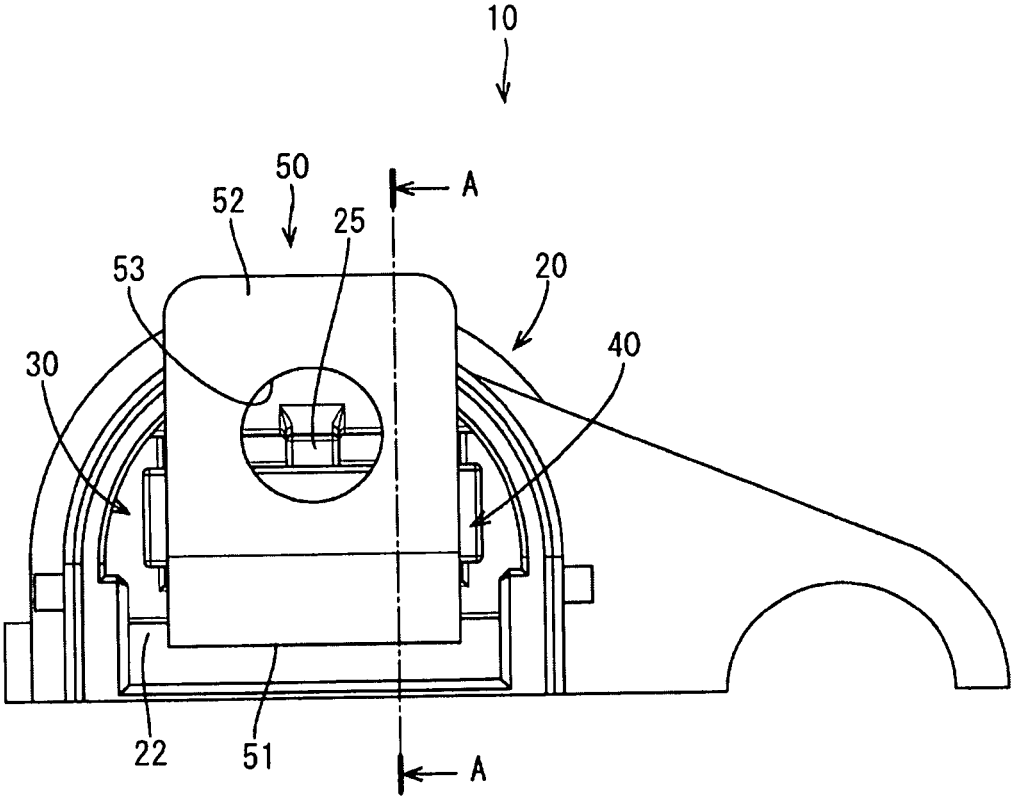
FIG. 3 is a front view of the connector after the male terminal is inserted.
Figure 4:
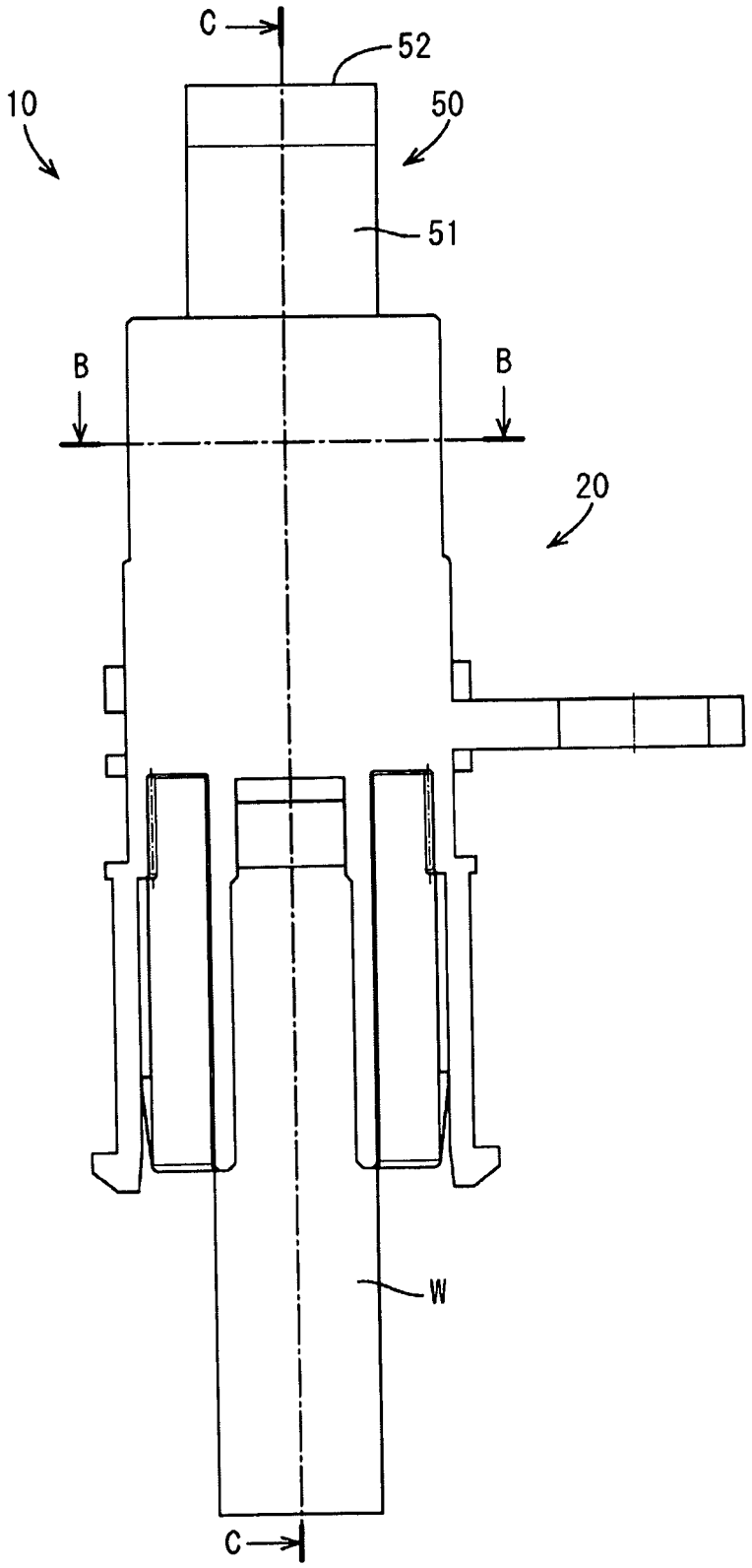
FIG. 4 is a plan view of the connector after the male terminal is inserted.
Figure 9:
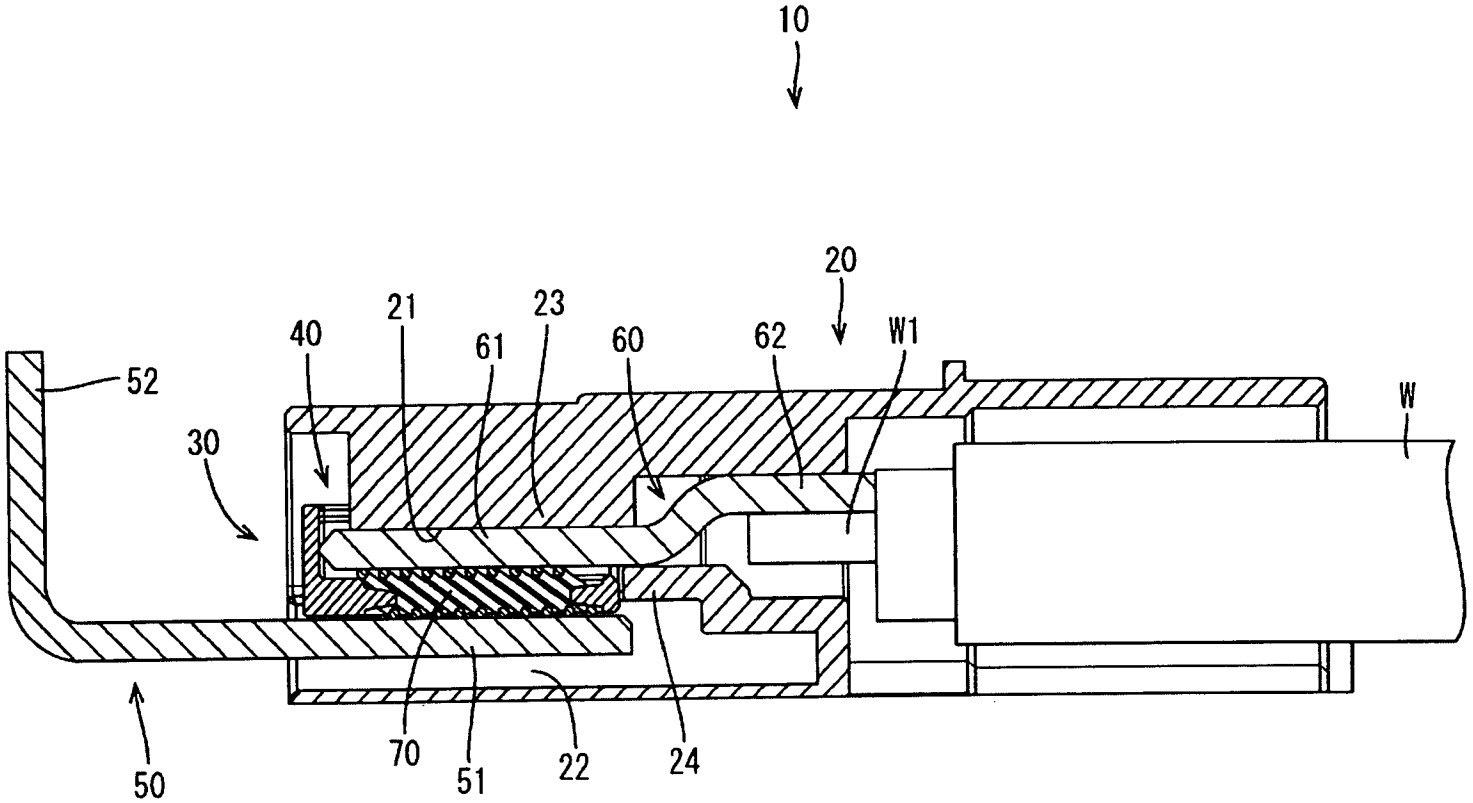
FIG. 9 is a section along C-C of FIG. 4.

As shown in FIG. 9, the male terminal 50 includes a terminal-side connecting portion 51 to be connected to the female terminal 60 via the coil springs 70 and a device-side connecting portion 52 to be connected, for example, to a device-side terminal provided in a device. The terminal-side connecting portion 51 and the device-side connecting portion 52 are coupled in an L shape. The terminal-side connecting portion 51 is a busbar in the form of a flat plate. On the other hand, the device-side connecting portion 52 includes a bolt hole 53 for connection to the device-side terminal by a bolt, as shown in FIG. 3.

As shown in FIG. 9, the female terminal 60 includes a terminal-side connecting portion 61 to be connected to the male terminal 50 via the coil springs 70 and a wire-side connecting portion 62 connected to a core W1 of a wire W. The terminal-side connecting portion 61 and the wire-side connecting portion 62 are coupled in a stepped manner via a step. The terminal-side connecting portion 61 is a busbar in the form of a flat plate. On the other hand, the core W1 of the wire W is connected to the wire-side connecting portion 62 by resistance welding or the like.

Figure 7:
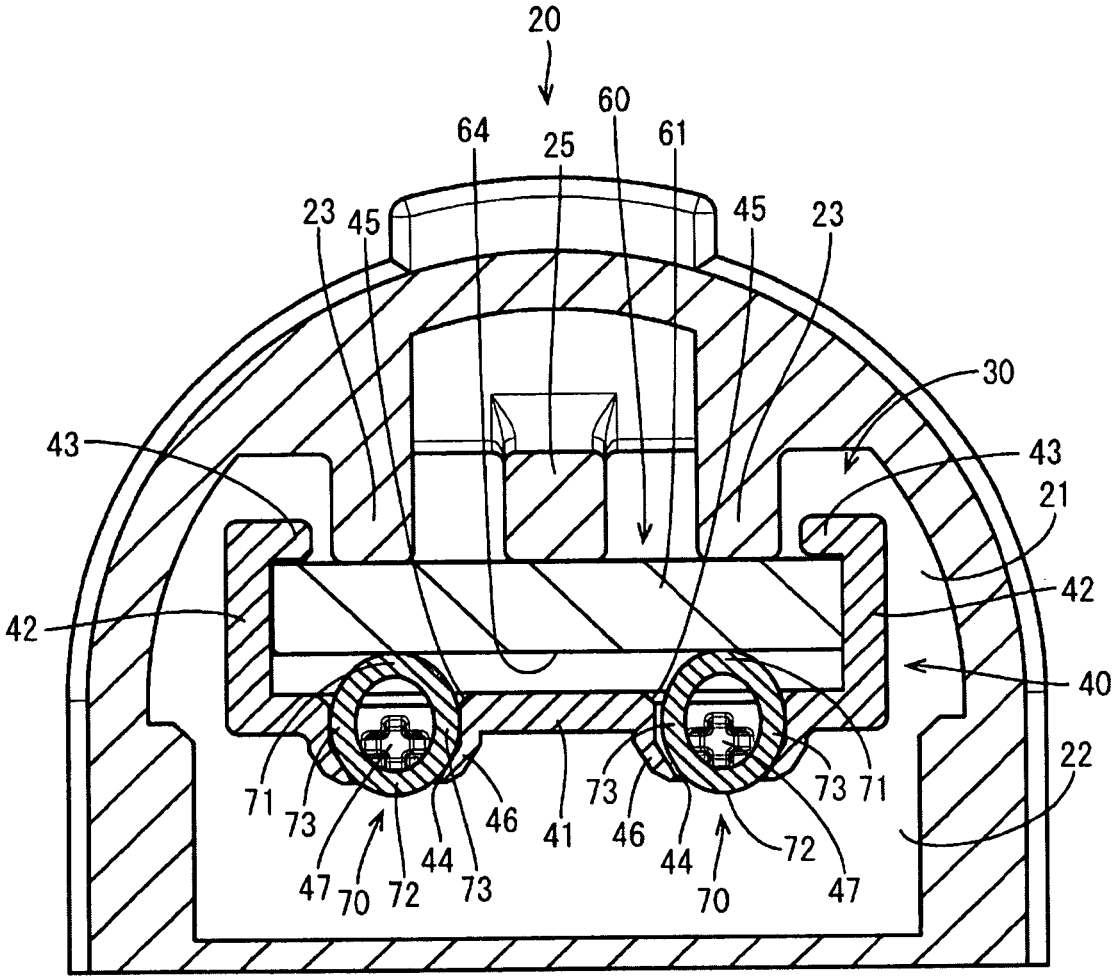
FIG. 7 is a section along B-B of FIG. 4 showing the connector before the male terminal is inserted.

The housing 20 includes a female terminal inserting portion 21 into which the female terminal 60 is inserted and a male terminal inserting portion 22 into which the male terminal 50 is inserted. The female terminal inserting portion 21 includes two upper contacts 23, a lower contact 24 and a female terminal holding portion 25. As shown in FIG. 9, the lower contact 24 contacts the female terminal 60 from below, and the upper contacts 23 contacts the female terminal 60 from above. As shown in FIG. 7, the upper contacts 23 are provided while being spaced apart in a width direction. The female terminal holding portion 25 is provided between the two upper contacts 23. The female terminal holding portion 25 is a cantilevered locking lance, and is fit into a lance hole in the terminal-side connecting portion 61 of the female terminal 60 to lock the terminal-side connecting portion 61. In this way, the terminal-side connecting portion 61 of the female terminal 60 is retained by the female terminal holding portion 25 while being vertically positioned by the two upper contacts 23 and the lower contact 24.

Figure 8:
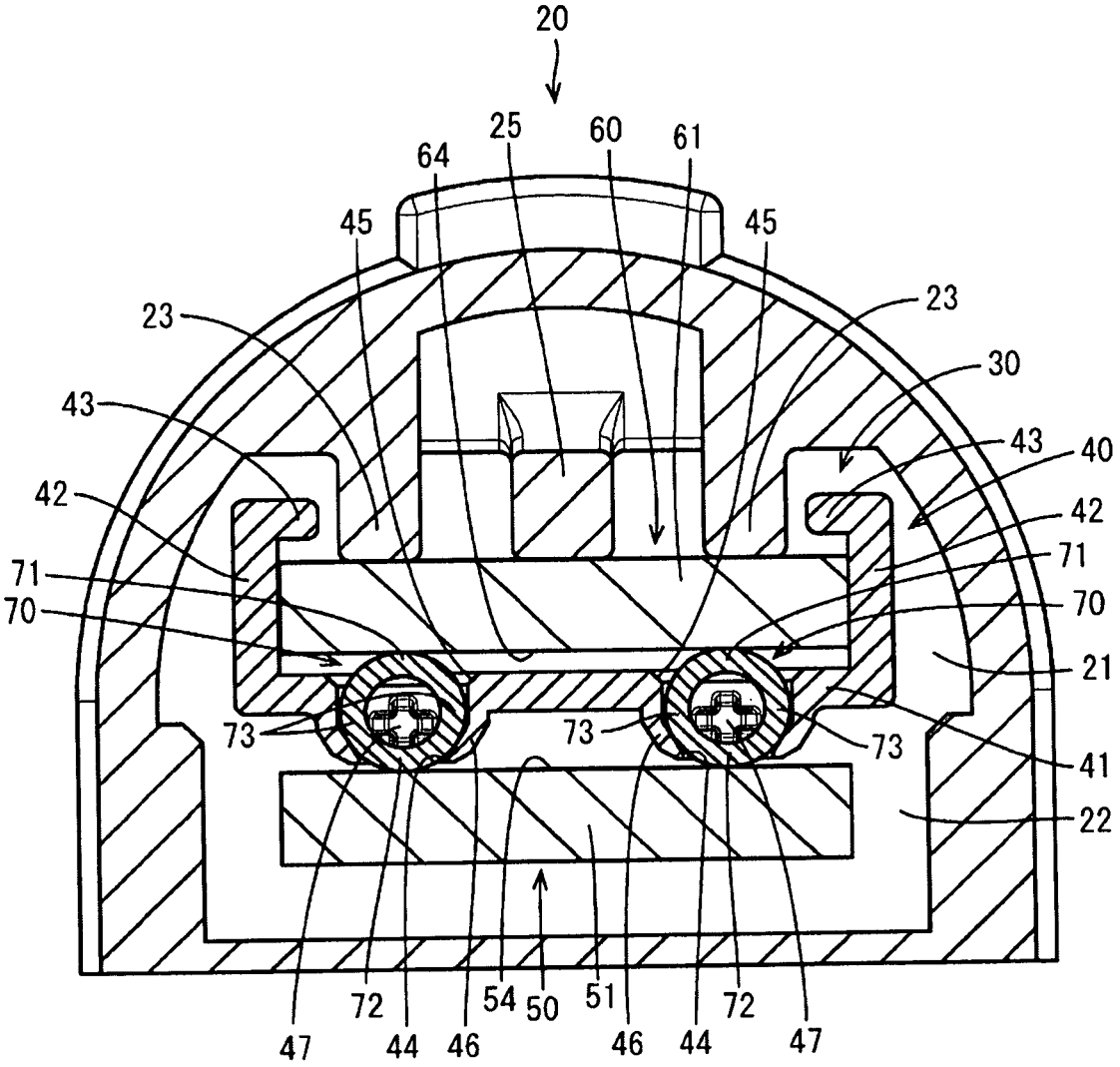
FIG. 8 is a section along B-B of FIG. 4 showing the connector after the male terminal is inserted.

As shown in FIG. 7, the spring holder 40 is mounted on the terminal-side connecting portion 61 of the female terminal 60. The male terminal inserting portion 22 is provided below the spring holder 40 inside the housing 20. A vertical dimension of the male terminal inserting portion 22 is slightly smaller than twice the plate thickness of the terminal-side connecting portion 51 of the male terminal 50, as shown in FIG. 8. Thus, even if the plate thickness of the terminal-side connecting portion 51 is increased by about 1.5 times, the shape of the housing 20 need not be changed.

As shown in FIG. 6, the coil spring 70 includes female-side contact points 71 to be brought into contact with a female-side contact surface 64, which is the lower surface of the terminal-side connecting portion 61 of the female terminal 60, male-side contact points 72 to be brought into contact with a male-side contact surface 54, which is the upper surface of the terminal-side connecting portion 51 of the male terminal 50. Arcuate couplings 73 connect the male-side contact points 72 and the corresponding female-side contact points 71. Specifically, the coil spring 70 is an obliquely wound coil spring in such a posture that the couplings 73 are inclined with respect to an axial center in a side view.

As shown in FIG. 7, the spring holder 40 includes a bottom wall 41 for supporting two of the coil springs 70, two side walls 42 rising up from both side edges of the bottom wall 41 and two holding portions 43 each projecting from the upper edge of one side wall 42 toward the upper edge of the other side wall 42 by a plate thickness. A separation distance between the side walls 42 is substantially equal to or slightly longer than a width of the terminal-side connecting portion 61 of the female terminal 60. Thus, if the spring holder 40 is mounted on the terminal-side connecting portion 61 of the female terminal 60, the holding portions 43 are hooked to both side edges of the terminal-side connecting portion 61 from above so that the spring holder 40 is held on the terminal-side connecting portion 61 by the two holding portions 43.

The bottom wall 41 includes male-side openings 44 for exposing the male-side contact points 72 of the coil springs 70 and female-side openings 45 for exposing the female-side contact points 71 of the coil springs 70. The male-side openings 44 are open in the bottom ends of coil accommodating portions 46 for causing the bottom wall 41 to bulge down. On the other hand, the female-side openings 45 are openings of the bottom wall 41 coupled to upper ends of the coil accommodating portions 46. Thus, the male-side contact points 72 of the coil springs 70 project down from the male-side openings 44 and are exposed to outside, and the female-side contact points 71 project up from the female-side openings 45 and are exposed to outside. Although the female-side contact points 71 are in contact with the female-side contact surface 64 of the female terminal 60 in FIG. 7, the female-side contact points 71 need not necessarily be in contact. Note that a protection wall 48 is provided on the front edges of the bottom wall 41 and the two side walls 42 for covering and protecting a front part of the terminal-side connecting portion 61 of the female terminal 60.

If the terminal-side connecting portion 51 of the male terminal 50 is inserted into the male terminal inserting portion 22 of the housing 20 from the front, the male-side contact surface 54 is disposed in the male-side openings 44 and the female-side contact surface 64 is directed toward the female-side openings 45. Thus, the male-side contact surface 54 and the female-side contact surface 64 face each other. As a result, the male-side contact surface 54 of the male terminal 50 resiliently contacts the male-side contact points 72 of the coil springs 70, the coil springs 70 are compressed in the vertical direction (direction in which the male-side contact surface 54 and the female-side contact surface 64 face each other), and the coil springs 70 are sandwiched between the male-side contact surface 54 of the male terminal 50 and the female-side contact surface 64 of the female terminal 60.

The coil accommodating portion 46 of the spring holder 40 includes two spring receiving projections 47 to be inserted into the coil spring 70 through both end openings in an axial direction of the coil spring 70. If the male-side contact points 72 of the coil spring 70 approach the female-side contact points 71, the inner surfaces of the male-side contact points 72 displace the spring receiving projections 47 upward. In this way, the two holding portions 43 of the spring holder 40 are separated upward from the upper surface of the terminal-side connecting portion 61 of the female terminal 60, and the spring holder 40 moves such that the female-side openings 45 approach the female-side contact surface 64, as shown in FIG. 8.

In a state of FIG. 8, the terminal-side connecting portion 61 of the female terminal 60 is located in the middle between the bottom wall 41 and the holding portions 43. Accordingly, a clearance formed between the terminal-side connecting portion 61 and the bottom wall 41 is substantially the same as a clearance formed between the terminal-side connecting portion 61 and the two holding portions 43. This means that a displacement of the spring holder 40 is allowed within the range of the clearance even if the spring holder 40 is displaced upward, for example, due to an increase in the plate thickness of the male terminal 50. Thus, even if the size of the male terminal 50 is changed, the shape of the spring holder 40 need not be changed. Further, vibration input from the wire W can be absorbed by the deformation of the coil springs 70. Furthermore, a contact point variation due to the twist of the male and female terminals 50, 60 can be followed by using the coil springs 70.

Figure 5:
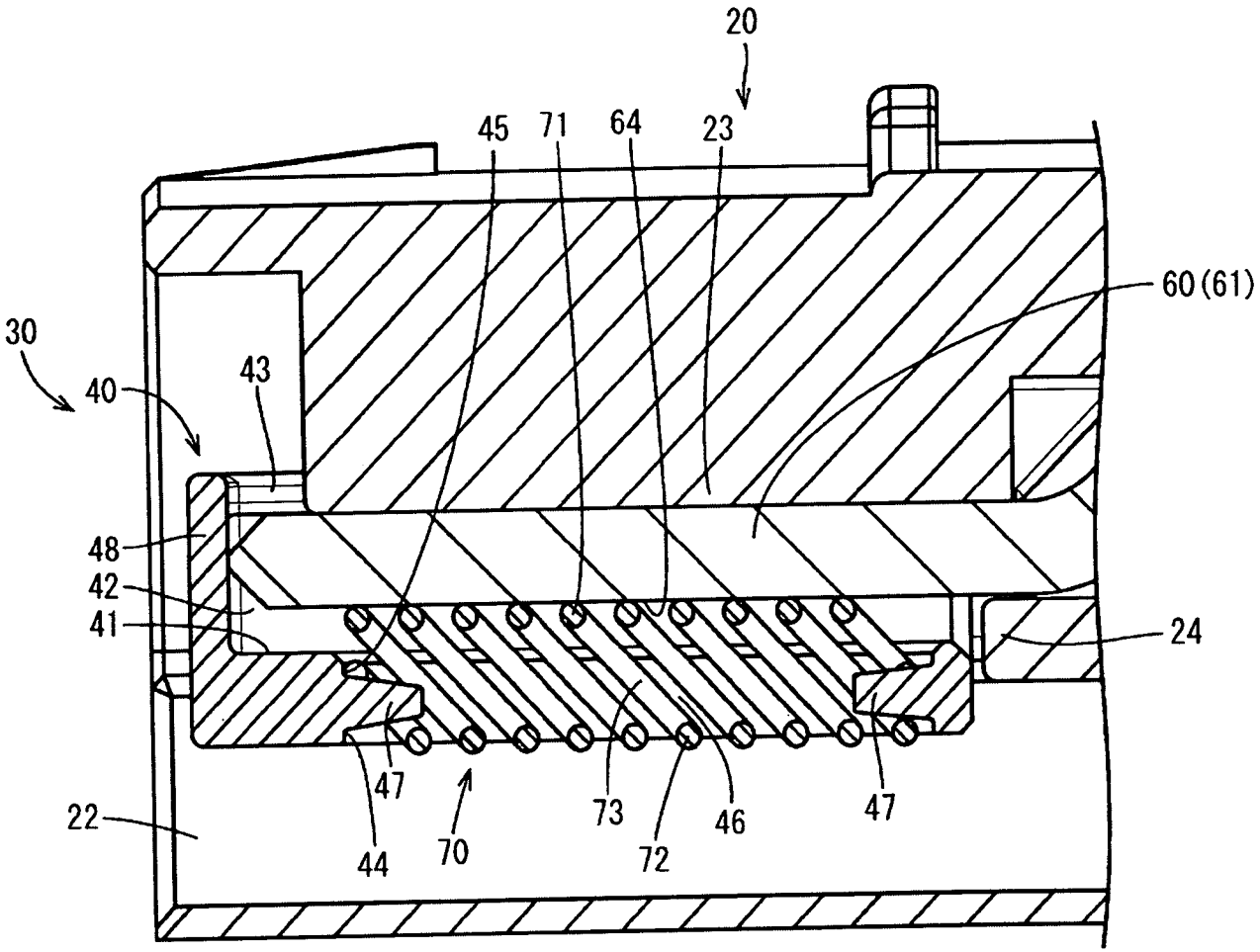
FIG. 5 is a section along A-A of FIG. 3 showing the connector before the male terminal is inserted.
Figure 6:
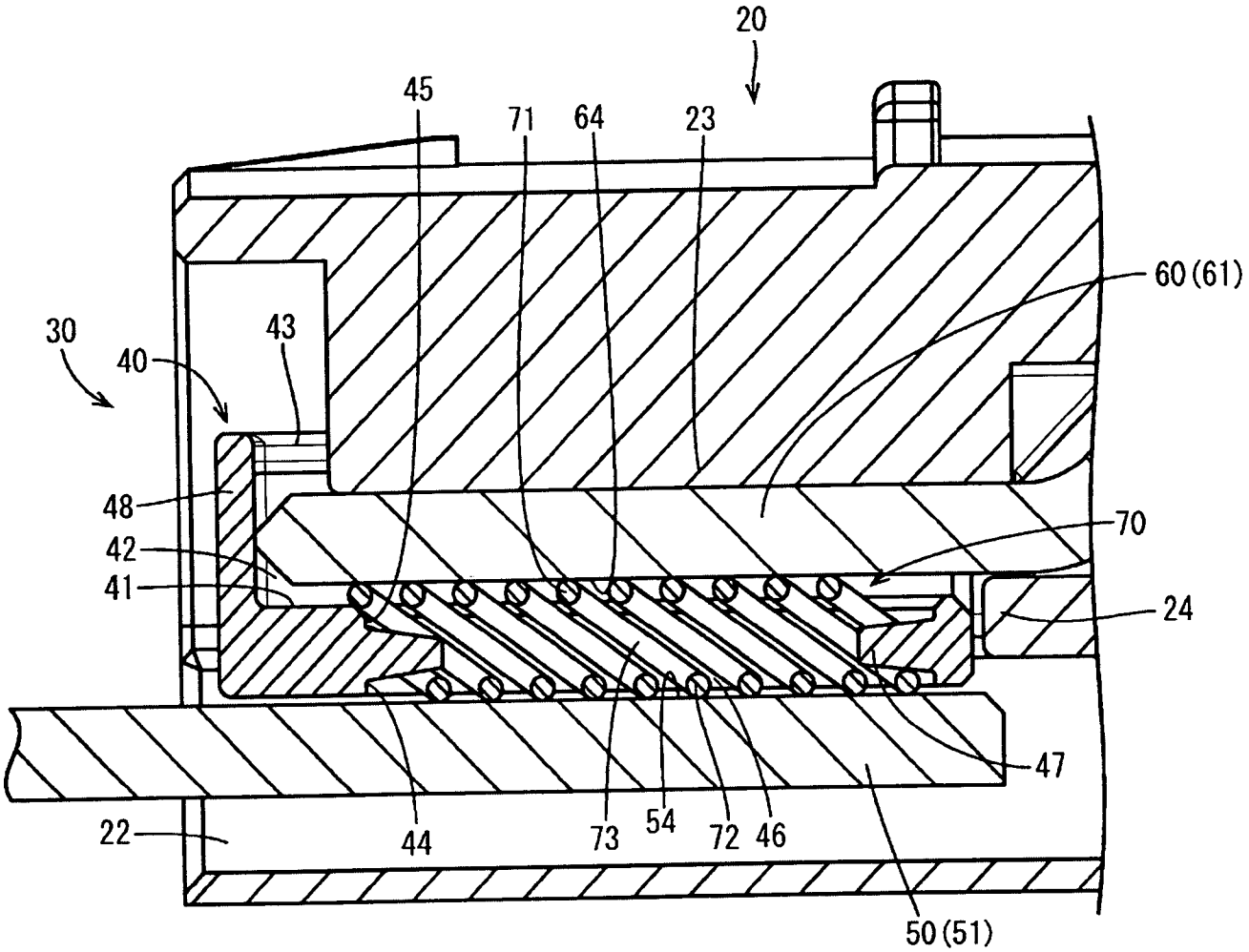
FIG. 6 is a section along A-A of FIG. 3 showing the connector after the male terminal is inserted.

As shown in FIG. 5, the male terminal 50 is inserted into the male terminal inserting portion 22 from one end (left end in FIG. 5) toward the other end (right end in FIG. 5) of each male-side opening 44. In other words, the male terminal 50 is inserted in parallel to axial centers of the coil springs 70 from the front of the male terminal inserting portion 22. In a side view, an angle of inclination of the couplings 73 with respect to the female-side contact surface 64 serving as a reference surface is an obtuse angle on one end of each female-side opening 45 and an acute angle on the other end. Thus, when the male terminal 50 is inserted into the male terminal inserting portion 22 from the front, the couplings 73 are tilted and the male-side contact points 72 are displaced up. Therefore, an insertion force of the male terminal 50 can be reduced.

On the other hand, with the male terminal 50 inserted inside the male terminal inserting portion 22, the angle of inclination of the couplings 73 with respect to the male-side contact surface 54 serving as a reference surface is an acute angle on one end of each male-side opening 44 and an obtuse angle on the other end in a side view, as shown in FIG. 6. If an attempt is made to separate the male terminal 50 from the male terminal inserting portion 22 in this state, the couplings 73 hold on to stand up. Thus, the vertical drag of the male-side contact points 72 against the male-side contact surface 54 increases and a frictional force increases. Accordingly, the male terminal 50 is connected to the coil springs 70 with a high holding force and hardly separated from the coil springs 70. Thus, the male terminal 50 and the coil springs 70 are connected conductively with high connection reliability. Further, since a current flowing between the contact points 71 and 72 is diverted to the two coupling portions 73, a parallel circuit is formed to reduce electrical resistance, and heat generation associated with an increase of the electric resistance can be suppressed. Therefore, a large current can be dealt with.

As described above, in this embodiment, the coil springs 70 are compressed and sandwiched in the facing direction of the contact surfaces 54, 64 by the male-side contact surface 54 of the male terminal 50 and the female-side contact surface 64 of the female terminal 60. Thus, the terminals 50, 60 are connected conductively. At this time, the spring holder 40 is moved such that the female-side openings 45 approach the female-side contact surface 64. By adopting this configuration, the spring holder 40 moves as the coil springs 70 are compressed, for example, even if the size of a male terminal is increased and the coil springs 70 are compressed more. Thus, the shape of the spring holder 40 need not be changed.

On the other hand, for example, if the size of a female terminal is increased, the coil springs 70 merely have to be compressed between the female-side contact surface 64 and the spring holder 40. Thus, the shape of the spring holder 40 need not be changed. Similarly, even if the size of coil springs is increased, the coil springs 70 merely have to be compressed between the female-side contact surface 64 and the spring holder 40. Thus, the shape of the spring holder 40 need not be changed. Therefore, the sizes of the male and female terminals 50, 60 and the coil springs 70 can be changed in the large current terminal 30 without difficulty.

The coil spring 70 includes the arcuate couplings 73 connecting the male-side contact points 72 and the corresponding female-side contact points 71, the couplings 73 are inclined with respect to the axial center in a side view, the male terminal 50 is inserted in parallel to the axial centers of the coil springs 70 from the one end toward the other end of each male-side opening 44, and the angle of inclination of the couplings 73 with respect to the male-side contact surface 54 serving as the reference surface is an acute angle on one end of each male-side opening 44 and an obtuse angle on the other end in a side view.

According to this configuration, since the angle of inclination of the couplings 73 is an acute angle on the one end of each male-side opening 44, the coil springs 70 are deformed to tilt the couplings 73 when the male terminal 50 is inserted from the one end toward the other end of each male-side opening 44. Thus, the male terminal 50 can be inserted with a low insertion force. On the contrary, if an attempt is made to separate the male terminal 50 from the other end toward the one end of each male-side opening 44, the couplings 73 hold on to stand up. Thus, the vertical drag of the male-side contact points 72 against the male-side contact surface 54 increases and the frictional force increases. Therefore, the male terminal 50 is connected to the coil springs 70 with a high holding force and hardly separates from the coil springs 70.

Further, the connector 10 disclosed by this specification is provided with the large current terminal 30 and the housing 20. The housing 20 includes the female terminal holding portion 25 for holding the female terminal 60 and the male terminal inserting portion 22 into which the male terminal 50 is inserted. The female terminal 60 is a busbar in the form of a flat plate, and the spring holder 40 includes the two holding portions 43 to be hooked to the side edges of the female terminal 60 from a side opposite to the female-side contact surface 64 and is held on the female terminal 60 by the holding portions 43.

According to this configuration, if the female terminal 60 is held by the female terminal holding portion 25 and the spring holder 40 is mounted on the female terminal 60, the spring holder 40 is held on the female terminal 60 by the two holding portions 43. If the male terminal 50 subsequently is inserted into the male terminal inserting portion 22, the male and female terminals 50, 60 are connected conductively via the coil springs 70.

The invention is not limited to the above described and illustrated embodiment. For example, the following various modes are also included.

The male terminal 50 is inserted parallel to the axial centers of the coil springs 70 from one end toward the other end of each male-side opening 44 in the above embodiment. However, the male terminal 50 may be connected by contacting the coil springs 70 from below the male-side openings 44.

Obliquely wound coil springs having winding surfaces oblique to the axial centers are illustrated in the above embodiment. However, coil springs having winding surfaces substantially perpendicular to axial centers may be used.

Although the male terminal 50 connected to the device-side terminal is illustrated in the above embodiment, the male terminal may be connected to a wire. In this case, the male and female terminals 50, 60 may be connected by fitting a male housing holding the male terminal 60 to the housing 20.

LIST OF REFERENCE SIGNS

10 . . . connector
20 . . . housing
22 . . . male terminal inserting portion
25 . . . female terminal holding portion
30 . . . large current terminal
40 . . . spring holder
43 . . . holding portion
44 . . . male-side opening
45 . . . female-side opening
50 . . . male terminal
54 . . . male-side contact surface
60 . . . female terminal
64 . . . female-side contact surface
70 . . . coil spring
71 . . . female-side contact point
72 . . . male-side contact point
73 . . . coupling

The invention claimed is:

1. A large current terminal, comprising:

a male terminal having a male-side contact surface;

a female terminal having a female-side contact surface;

a coil spring including a center axis, male-side contact points spaced apart in a direction parallel to the center axis and to be brought into contact with the male-side contact surface, female-side contact points spaced apart in the direction parallel to the center axis and to be brought into contact with the female-side contact surface, and arcuate couplings connecting the male-side contact points and the corresponding female-side contact points, the couplings being oblique to the center axis, the coil spring conductively connecting the male terminal and the female terminal; and a spring holder including a male-side opening for exposing the male-side contact points and a female-side opening for exposing the female-side contact points, the spring holder holding the coil spring;

the coil spring being compressed in a facing direction of the contact surfaces by disposing the male-side contact surface in the male-side opening while causing the male-side contact surface to face the female-side contact surface with the female-side contact surface directed toward the female-side opening, the spring holder being movable such that the female-side opening approaches the female-side contact surface as the coil spring is compressed;

the male terminal is inserted parallel to the center axis of the coil spring from a first end toward a second end of the spring holder; and an angle of inclination of the couplings with respect to the male-side contact surface serving as a reference surface is an acute angle on the first end of the male-side opening and an obtuse angle on the second end in the side view.

2. The large current terminal of claim 1, wherein:

the female terminal is a busbar in the form of a flat plate, the spring holder including two holding portions to be hooked to both side edge parts of the female terminal from a side opposite to the female-side contact surface and being held on the female terminal by the two holding portions.

3. A connector, comprising:

a large current terminal including:

a male terminal having a male-side contact surface;

a female terminal having a female-side contact surface;

a coil spring including a center axis, male-side contact points spaced apart in a direction parallel to the center axis and to be brought into contact with the male-side contact surface, female-side contact points spaced apart in the direction parallel to the center axis and to be brought into contact with the female-side contact surface, and arcuate couplings connecting the male-side contact points and the corresponding female-side contact points, the couplings being oblique to the center axis, the coil spring conductively connecting the male terminal and the female terminal; and a spring holder including a male-side opening for exposing the male-side contact points and a female-side opening for exposing the female-side contact points, the spring holder holding the coil spring; and a housing including a female terminal holding portion for holding the female terminal and a male terminal inserting portion, the male terminal being inserted into the male terminal inserting portion; wherein:

the coil spring is compressed in a facing direction of the contact surfaces by disposing the male-side contact surface in the male-side opening while causing the male-side contact surface to face the female-side contact surface with the female-side contact surface directed toward the female-side opening, the spring holder being movable such that the female-side opening approaches the female-side contact surface as the coil spring is compressed;

the male terminal is inserted parallel to the center axis of the coil spring from a first end toward a second end of the spring holder;

an angle of inclination of the couplings with respect to the male-side contact surface serving as a reference surface is an acute angle on the first end of the male-side opening and an obtuse angle on the second end in the side view; and the female terminal being a busbar in the form of a flat plate, the spring holder including two holding portions to be hooked to both side edge parts of the female terminal from a side opposite to the female-side contact surface and being held on the female terminal by the two holding portions.

* * * * *